US005312462A

United States Patent [19]

Nowak

[11] Patent Number: 5,312,462

[45] Date of Patent: May 17, 1994

[54] MOIST CAUSTIC LEACHING OF COAL

[75] Inventor: Michael A. Nowak, Elizabeth, Pa.

[73] Assignee: The United States of America as represented by the United States Department of Energy, Washington, D.C.

[21] Appl. No.: 956,933

[22] Filed: Oct. 2, 1992

Related U.S. Application Data

[63] Continuation of Ser. No. 748,373, Aug. 22, 1991, abandoned.

[51] Int. Cl.[5] ..... C10L 10/00

[52] U.S. Cl. ..... 44/624; 44/627

[58] Field of Search ..... 44/627, 624

[56] References Cited

U.S. PATENT DOCUMENTS

| | | | |
|---|---|---|---|
| 3,993,455 | 11/1976 | Reggel et al. | 44/1 R |
| 4,055,400 | 10/1977 | Stambaugh et al. | 44/627 |
| 4,092,125 | 5/1978 | Stambaugh et al. | 44/627 |
| 4,095,955 | 6/1978 | Stambaugh et al. | 44/627 |
| 4,099,929 | 7/1978 | Tippner et al. | 44/627 |
| 4,497,636 | 2/1985 | Aida et al. | 44/15 R |
| 4,516,980 | 5/1985 | Wheelock | 44/627 |
| 4,569,678 | 2/1986 | Simpson | 44/627 |
| 4,574,045 | 3/1986 | Crossmore, Jr. | 44/627 |
| 4,582,512 | 4/1986 | Smit et al. | 44/627 |
| 4,775,387 | 10/1988 | Narain et al. | 44/624 |
| 4,936,045 | 6/1990 | Waugh et al. | 44/627 |

OTHER PUBLICATIONS

Utz et al., "Molten Hydroxide Coal Desulfurization Using Model Systems", Jun. 9, 1986.

Boron, "Prospects for Chemical Coal Cleaning" American Society of Mining Engineers Fall Meeting, 1983.

ORNL/TM-5953 "Survey and Evaluation of Current and Potential Coal Beneficiation Process" Mar. 1979, pp. 107-126.

*Primary Examiner*—Margaret Medley

*Attorney, Agent, or Firm*—Hugh W. Glenn; Robert J. Fisher; William R. Moser

[57] ABSTRACT

A process for reducing the sulfur and ash content of coal. Particulate coal is introduced into a closed heated reaction chamber having an inert atmosphere to which is added 50 mole percent NaOH and 50 mole percent KOH moist caustic having a water content in the range of from about 15% by weight to about 35% by weight and in a caustic to coal weight ratio of about 5 to 1. The coal and moist caustic are kept at a temperature of about 300° C. Then, water is added to the coal and caustic mixture to form an aqueous slurry, which is washed with water to remove caustic from the coal and to produce an aqueous caustic solution. Water is evaporated from the aqueous caustic solution until the water is in the range of from about 15% by weight to about 35% by weight and is reintroduced to the closed reaction chamber. Sufficient acid is added to the washed coal slurry to neutralize any remaining caustic present on the coal, which is thereafter dried to produce desulfurized coal having not less than about 90% by weight of the sulfur present in the coal feed removed and having an ash content of less than about 2% by weight.

10 Claims, 1 Drawing Sheet

MOIST CAUSTIC LEACHING OF COAL

CONTRACTUAL ORIGIN OF THE INVENTION

The U.S. Government has rights in this invention pursuant to the employer-employee relationship of the U.S. Department of Energy and the inventor.

This is a continuation of application Ser. No. 748,373 filed Aug. 22, 1991 now abandoned.

BACKGROUND OF THE INVENTION

This invention relates to a method of removing organic and inorganic sulfur compounds from coal and other carbonaceous combustible materials.

The recent energy crisis has increased the consumption of coal in the United States. However, there are many problems which need to be solved concerning the use of coal, the most important of which is environmental pollution. Most coal found in the United States contains from 0.5 to 10 weight percent sulfur which when burned is emitted as sulfur dioxide causing serious pollution problems in the atmosphere. Moisture in the atmosphere combines with the sulfur dioxide to produce acid rain, the consequences of which are far reaching and deleterious.

Because of the adverse impact of large quantities of sulfur from burning coal, it is necessary to reduce substantially the amount of sulfur which is released to the atmosphere. Only a small fraction of the available coal can be burned directly without violating current pollution control regulations. Thus, methods are being developed either to decrease the amount of sulfur in the coal before it is combusted or to remove sulfur from flue gas. However, flue gas desulfurization is expensive because of the high cost of the capital equipment and the cost of maintaining that equipment. Precombustion processes include conventional physical cleaning such as by comminution, chemical treatment, magnetic separation and coal conversion such as gasification and liquification.

Most physical cleaning methods separate mineral impurities from coal, utilizing differences in density of coal and mineral matter. This method only removes coarse mineral particles which are easily released, while leaving the finer particles in the coal. Coal gasification and liquification are not yet fully developed and are expensive. Magnetic separation can remove only liberated particles but does remove some ash forming minerals in addition to some of the sulfur. Chemical cleaning methods, which remove both organic and inorganic sulfur, are more effective than physical cleaning methods and are generally more economical than gasification and/or liquification.

Sulfur in coal may be classified into two general types, organic and inorganic. Organic sulfur is chemically bounded to the coal hydrocarbon matrix can only be removed by chemical means. Inorganic sulfur is present in coal with pyrite ($FeS_2$) and in small amounts as a sulfate (generally, calcium or ferrous sulfate). Pyritic sulfur may range from about 0.5 to abut 10 percent by weight with individual particles of pyrite ranging from a few microns to a few inches in diameter. Large, liberated pyrite particles can be removed by hand or by various mechanical cleaning methods, but the particles that are finely distributed in the coal matrix need first to be liberated by fine grinding. Grinding and overgrinding produces a large percentage of fine material which is expensive not only because grinding to fine materials is costly but also the finer the coal, the more difficult in processing thereafter.

A number of different processes have been developed for the removal of organic and inorganic sulfur from coal and other burnable carbonaceous materials for reducing the ash content thereof. One method is known as the Gravimelt Process. The method is based on treating one part of finely powdered coal with approximately ten parts of a fused alkali such as sodium hydroxide, potassium hydroxide or mixtures thereof at 300° C. to 400° C. for 20–70 minutes. After removal of the coal floating on top of the melt and washing extensively with water to remove residual alkali and reaction products, substantial reductions in the sulfur content can be achieved. Subsequent washing of the treated coal with dilute sulfuric acid removes much of the mineral matter and neutralizes any remaining alkali, leaving a product that is relatively low in sulfur and low in ash content. Approximately ten percent of the original sulfur is present and approximately two percent ash is present by weight of the final product.

In another process for removing sulfur, a slurry of finely divided coal is in a solvent of methylchloroform, carbon tetrachloride or tetrachloroethylene and 30–70 weight percent water is prepared. Gaseous chlorine is bubbled through the slurry at 60°–130° C. and from 0–60 psig for about 45–90 minutes to oxidize the coal. The process will remove about 60 percent of the total sulfur in the coal removing about 50 percent of the organic sulfur and about 70 percent of the pyritic sulfur. While the process is reasonably effective, it is not as effective as the Gravimelt Process leaving about 50 percent of the organic sulfur in the coal. In addition, substantial amounts of residual chlorine remain in the coal which can produce highly corrosive combustion products upon burning.

The patent to Aida et al. U.S. Pat. No. 4,497,636 issued Feb. 5, 1985 attempts to combine the Gravimelt technology and the chlorinating technology in which chlorine gas is used as an oxidant and thereafter the carbonaceous material separated from the liquid chlorine is contacted with molten caustic, the operating temperatures used being in the range of from about 250°–400° C. with about 325° C. being preferred. The results reported are about 90 percent of the total sulfur present in the coal being removed. Lower concentrations of alkali have been used to remove sulfur as reported in the Reggel et al. U.S. Pat. No. 3,993,455 and alkali has been used in super critical fluid conditions supposedly to release sulfur as reported in the Narain et al. U.S. Pat. No. 4,775,387. The three patents referred to, these being the Reggel et al. patent, the Aida et al. patent and the Narain et al. patent are all assigned to the assignee of the present invention and illustrate a portion of the resources of the government devoted to finding better and cleaner methods for burning coal.

SUMMARY OF THE INVENTION

In accordance with the present invention an improvement in the Gravimelt Process is provided for removing sulfur from carbonaceous material. The method involves using moist caustic having a water content in the range of from about 15 percent by weight to about 35 percent by weight to remove sulfur from relatively large coal particles in the $14\times0$ to $28\times0$ mesh range at temperatures of about 300° C., about 20 percent lower than used in the TRW Gravimelt Process as actually practiced.

Another aspect of the invention is various combinations of caustic may be used having about 20 percent by weight water with reaction times in the thirty minute to one hour time frame and at the lower temperature of about 300° C. to remove about 90 percent by weight of the sulfur present in the coal and to produce a product having ash present in the range of from about 0.5 to about 2 percent by weight.

It is therefore one object of the invention to provide an improved process for removing sulfur from carbonaceous material.

It is another object of the invention to provide an improved process for the removal of both inorganic and organic sulfur from carbonaceous material at lower temperatures than heretofore possible.

Another object of the invention is to provide an improved process for the removal of sulfur wherein less energy is required to treat the slurry containing the caustic in order to recover caustic for recycle into the process at lower cost.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE INVENTION

Figure 1:
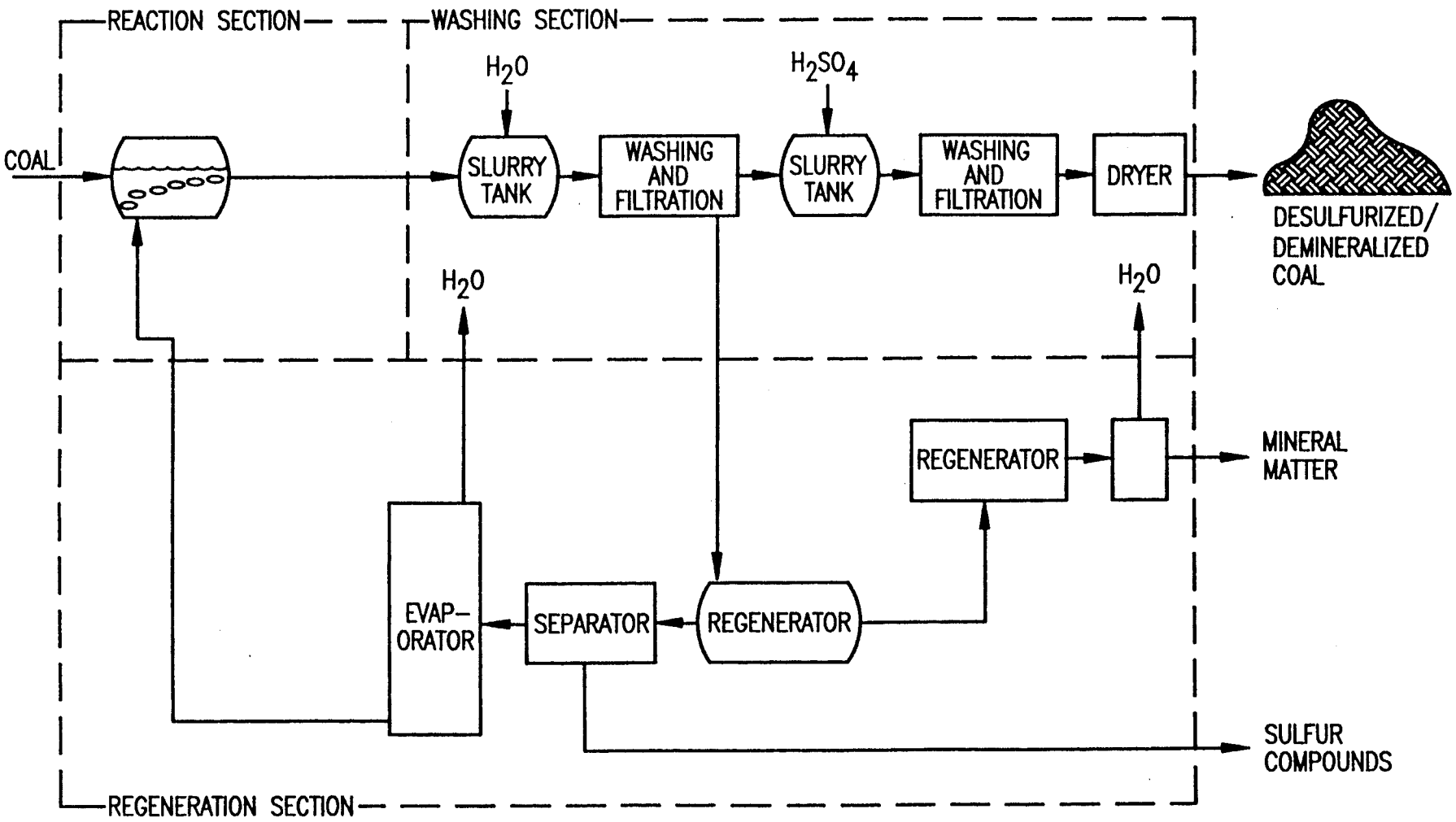
FIG. 1 is a schematic flow diagram of the process of the present invention.

The molten caustic leaching (MCL) process wherein coal is treated with alkali hydroxides at relatively high temperatures, and thereafter washed with water to remove excess alkali and soluble mineral matter and sulfide is capable of removing in excess of 90 percent of all sulfur present in the coal, including organic sulfur, as well as nearly all the ash. One of the difficulties with the process is the reagent generation cycle which involves evaporating the water from the regenerated aqueous caustic solution to produce a dry caustic flake. There is also a concern that the combustion characteristics of the product fuel may be substantially changed due to a reduction in the volatile matter content, to the detriment of the remaining coal product. The TRW Gravimelt Process uses molten alkali having a water content less than 10 percent and therefore requires that the aqueous alkali-containing material be heated to remove sufficient water such that a regenerated molten caustic having a water content of less than 10 percent is produced. It is the requirement to regenerate dry molten caustic in configuration with the diminution in volatiles caused by using the "dry" caustic to remove sulfur which has been improved by the present invention. Accordingly, a narrow range of water was found to produce superior results.

Referring to FIG. 1, there is shown a schematic diagram of general process for the application of moist molten caustic to coal including a reaction section followed by a washing section and a regeneration section wherein sulfur compounds are discharged and moist caustic is returned to the reaction vessel. The entire reaction takes place in the presence of an inert atmosphere such as nitrogen which is the cheapest inert gas available and pressure builds during the reaction, dependent upon the temperature at which the reaction occurs, but is generally maintained at less than about 98 psig.

Preferably, the temperature is maintained at as low a value as possible while obtaining the requisite 90 percent sulfur removal. To this end, it has been found that about 300° C. suffices, a savings of approximately 75°-100° C. compared to the Gravimelt Process. FIG. 1 shows the reaction section including the coal reaction vessel into which it is added a moist caustic which may be various combinations of potassium and sodium hydroxides, preferably 50 mole percent of each having a water content in the range of from about 15 percent by weight to about 35 percent by weight with 20 percent by weight being preferred. After reacting in the pressurized heated vessel for a time in the range of from about 30 minutes to about one hour, the reactant material is transported to a slurry tank to which is added water to about 50 percent by weight. The products from the slurry tank are thereafter filtered with the aqueous caustic flowing to a regenerator to which lime is added precipitating the sulfur as calcium sulfides or sulfates and aluminum silicates, leaving in the regenerator aqueous sodium and/or potassium ions which are then filtered again in the separator and transported to an evaporator. In the evaporator, the aqueous potassium and sodium solutions are heated until again the caustic remaining has a moisture content in the range of from about 15 percent to about 35 percent by weight, the evaporated water being transmitted to the slurry tank as indicated in the figure. The sulfur from the regenerator is an off product of the process and as indicated by the arrow from the separator is recovered for further treatment or disposal.

The coal from the washing and filtration station is treated with a dilute acid, preferably a mineral acid and further preferably dilute sulfuric acid to remove any of the caustic remaining, the product from which is washed and filtered and sent to a dryer, and thereafter becomes the product of the process having a sulfur content reduced about 90 percent of the original sulfur and an ash content in the range of from between about 0.5 percent by weight to about 2 percent by weight. The mineral matter for removed ash is discharged from the system as indicated.

All caustic/coal tests were conducted in a 1 L magnetically stirred autoclave equipped with an Inconel liner and Inconel stirrer. The feed coal was a Pittsburgh No. 8 coal, that had been physically cleaned by heavy media (magnetite) cyclone and crushed to −14 mesh. Analyses of the ROM and cleaned coals are described in Tables 4 and 5. In a typical experiment, 10 grams of coal and 50 grams of caustic pellets were placed in the liner and the liner placed in the autoclave. The caustic pellets contained 50 mole percent sodium hydroxide and 50 mole percent potassium hydroxide (40:60 by weight). Experiments showed no advantage to pulverizing and blending the caustic before addition to the coal. The autoclave was flushed with argon or nitrogen. The system was established as leak free to 4000 psi inert gas, then brought to atmospheric pressure, unless otherwise noted. Experiments with added water were conducted in a sealed autoclave and the pressure allowed to reach equilibrium, unless otherwise noted. "Standard" MCL tests were operated with inert gas flowing through the reactor to a dry ice cooled trap. Heating was initiated and the stirrer was turned on when the internal temperature reached 200° C. The stirring was maintained at approximately 200 RPM. The run was considered to begin when the internal temperature reached the desired temperature, and reaction at temperature was 2 hours unless otherwise noted. At the end of the reaction time reported, the external heater was removed from the autoclave, and replaced with an external cooling coil. The internal temperature was brought to room temperature. Because of the close tolerances of the liner and body and very small amounts of coal tars condensing between them and acting as a "glue", it was sometimes necessary to bring the internal temperature back up to 200° C. to facilitate removal of the liner. Heat up times were approximately 30 to 45 minutes from 50° C. to 300° C. and cool down times were approximately 30 minutes to go below 200° C. without a cooling coil installed. In experiments with reaction times less than 2 hours, the contents of the reaction vessel were cooled to below 200° C. in less than 1 minute using an internal cooling coil.

The caustic cake was dissolved with a minimum amount of water (ca. 50 mL). In preliminary experiments, the Inconel liner and the autoclave were washed with methylene chloride to remove any low molecular weight organics, and, to isolate any non-alkali-soluble low molecular weight organics that might be present, after filtering the coal from the initial dissolved caustic solution, the filtered coal and the aqueous alkaline filtrate were each washed with a single 50 mL portion of methylene chloride.

In "standard" MCL runs, the purge line and the purge trap were rinsed with methylene chloride to remove any volatiles. The purge trap usually had small quantities of water in it. The $CH_2Cl_2$ wash and $CH_2Cl_2$ extract were combined. After removing solvent in vacuo, the combined weights of organic material from the purge trap and material readily removed from the coal by the $CH_2Cl_2$ wash were determined and were found to be negligible.

The coal was washed with four 500-mL portions of hot water followed by a wash with sufficient dilute HCl to bring the coal/water slurry to pH 1. The coal was given a final wash with four 500-mL portions of hot water. The coal was dried at 110° overnight, and the weight of recovered coal was determined. The aqueous waste streams were analyzed for water soluble and insoluble organic acids by neutralization and precipitation followed by GC analyses of the filtrates. Although they may be present, no water soluble acids were identified by GC. Some filtrate samples were analyzed for carbonate. Samples of the recovered coal were submitted for proximate analysis, sulfur forms analysis, and micro elemental (C,H,O,N,S) analyses.

The solubilities of sodium and potassium hydroxides in water are 347 and 178 grams, respectively per 100 ml at 100° C. A typical MCL mixture has a 6% water content. In the initial experiments, it was arbitrarily decided to add 10 grams of water to the coal/caustic mixture. In later experiments, 5, 10, or 20 grams of water were added. The water contents of the coal/caustic/water mixtures are summarized in Table 1.

TABLE 1

Weight Percent Water Content of Caustic Leaching Components and Mixtures for Various Amounts of Water Added to Coal/Caustic Mixtures

| Water Added, g | % $H_2O$ in Coal | % $H_2O$ in KOH | % $H_2O$ in NaOH | % $H_2O$ in KOH/NaOH Mix | % $H_2O$ in Coal/ Caustic Mix |
|---|---|---|---|---|---|
| 0 | 2.0 | 10.0 | 2.00 | 7 | 6 |
| 5 | 2.0 | 10.0 | 2.00 | 15 | 13 |
| 10 | 2.0 | 10.0 | 2.00 | 22 | 20 |
| 20 | 2.0 | 10.0 | 2.00 | 33 | 30 |

The initial results are presented in Table 2, which showed that with 10 grams of added water, the temperature required to consistently achieve 90% desulfurization was 300° C. At 275° C., a significant amount of organic sulfur is still removed, but total sulfur reduction is less than the 90% target level (as defined by the New Source Performance Standard). Since the proportion of sulfatic:pyritic:organic sulfur in the feed coal is 1:39:60, the "moist" caustic at 275° C. removed approximately two-thirds of the organic sulfur. In contrast, leaching with 5% aqueous sodium hydroxide at 300° C. is reported to remove only one-third of the organic sulfur from an Indiana No. 5 coal. The same report indicates that leaching Pittsburgh or Illinois seam coals at 225° C. with 10% NaOH gives poorer organic sulfur reduction. Water is necessary to balance the equation.

$$C_{10}H_8 + 20\ MOH + 10\ H_2O \longrightarrow 10\ M_2CO_3 + 24\ H_2 \quad (1)$$

It becomes evident that the water can be involved in the reaction and is not in the gas phase when the pressure/temperature data for the experiments are examined. For example, the maximum pressure achieved at 375° with 10 grams of water added is 550 psi. Below the critical temperature of water, the water remaining in the condensed phase, i.e. in the binary caustic/water mixture, during the course of these experiments was estimated at 50–80% of the water loading, depending on the water loading and temperature.

Since water and temperature seemed to be playing a critical role in the desulfurization and recovery of the coal, it was determined to examine the effect of water concentration. Therefore, tests were conducted with half (5 grams) and double (20 grams) the amount of added water as in the preliminary tests. An initial survey was conducted over the temperature range from 275°–375° C. and later efforts concentrated on leaching at 300° C. The sulfur reduction and fuel recovery achieved in these tests is summarized in Table 3.

TABLE 2

Comparison of Desulfurization by "Moist" and Molten Caustic Leaching

| Source[1] | Temp. °C. | Sulfur Reduction,[2] % | Mass Balance[3], % |
|---|---|---|---|
| TRW | 400 | 92 | — |
| TRW | 370 | 85 | — |
| TRW | 320 | 53 | — |
| MCL | 375 | 93 | 84 |
| MCL | 350 | 80 | 80 |
| MCL | 325 | 65 | 91 |
| MCL | 275 | 46 | 94 |
| Moist | 375 | 96[3] | 64 |
| Moist | 350 | 98 | 71 |
| Moist | 300 | 97 | 69 |
| Moist | 275 | 83 | 94 |

1. TRW means data taken from TRW 20 lb coal/hr Molten Caustic Leaching MCL tests. MCL refers to PETC MCL tests. 10 grams of coal treated with 50 grams of caustic. Moist refers to "moist" caustic leaching, conditions identical to MCL, but with 10 grams of water added and leaching conducted in a sealed, rather than open vessel.

2. All sulfur reductions are based on %=(lbs. $SO_2$/MM BTU ROM-lbs. $SO_2$/MM BTU product)/lbs. $SO_2$/MM BTU ROM * 100 except "moist" leaching at 375, which is based on %=(S in feed−S in product)/S in feed *100.

The data in Table 3 show that when 20 grams of water is added, coal recoveries are highest at low temperature and poorest at temperatures above 325° C. Desulfurization is poorer with the larger amount of added water, and, as before, satisfactory sulfur levels are achieved when the leaching temperature is at or above 300° C. It may be coincidental that with 20 grams of added water, the system is close to the maximum solubility of KOH in water at 100° C.

TABLE 3

Effect of Water Concentration and Temperature of Sulfur Reduction and Coal Recovery from Moist Caustic Leaching

| Grams Water Added | Temperature °C. | Percent Coal Recovered, maf basis | Reduction in Sulfur, % from ROM |
|---|---|---|---|
| 5 | 375 | 48 | 93 |
| 5 | 300 | 68 | 90 |
| 20 | 375 | 43 | 95 |
| 20 | 325 | 61 | 92 |
| 20 | 300 | 78 | 81 |
| 20 | 275 | 87 | 73 |

1. All sulfur reductions are based on %=(lbs $SO_2$/MM BTU ROM-lbs $SO_2$/MM BTU product)/lbs $SO_2$/MM BTU ROM * 100.

In an effort to investigate the dependence of desulfurization on carbon loss and close balances, it was speculated that the reactions leading to carbon loss may proceed at a different rate than those involving organic sulfur reduction. Tests were conducted at 300° C. with a residence time at temperature of 1.0, 0.75, 0.5, and 0.25 hours. When 10 grams of coal was treated with 30 grams of KOH, 20 grams of NaOH and 10 grams of water for 1 hour at 300° C., 80–90% sulfur reductions and mass balances up to 97% were achieved. The material was accounted for as 7.0% recovered solid fuel, 10% dissolved ash, and 17% humic acid. The average carbon balance was 91%. In tests with processing times of 0.25, 0.50 and 0.75 hours, 70+% fuel recoveries and 90+% mass and carbon balances were achieved but desulfurization levels averaged less than 80%. Efforts are under way to determine the reproductibility of these results. It appears that fuel recoveries can be improved, since the data seem to suggest that the reactions affecting coal recovery and sulfur reduction appear to have different rates as shown by the tests conducted at different treatment times. This observation is an important first step in gaining an understanding of moist caustic leaching chemistry.

One of the primary objectives was to improve the combustion characteristics of the product fuel, i.e., maintain the volatile matter content. We have determined that the resultant volatile matter content of the treated coal is a function of the leaching temperature. By leaching at 300° C. a low-sulfur, low-ash fuel product having a volatile matter content higher than typical MCL products can be obtained. The product characteristics of the feed coal and caustic leached coals are summarized in Tables 4 and 5.

TABLE 4

Product Characteristcs of Feed, MCL and Wet[1] Caustic Leached Coals

| Entry | Water Added, g | Temp. °C. | % S Reduction[2] | H/C | BTU/lb[3] | Ash, % | Volatile Matter, % |
|---|---|---|---|---|---|---|---|
| ROM | — | — | — | 0.90 | 9,100 | 36.0 | 26.04 |
| Feed | — | — | — | 0.83 | 13,200 | 9.36 | 46.50 |
| MCL[4] | 0 | 375 | ≧90.0 | 0.44 | 13.500 | <1.02 | 28.00 |
| 1 | 5 | 375 | 91.9 | 0.55 | 14,400 | 1.40 | 21.76 |
| 2 | 5 | 300 | 86.0 | 0.82 | 14,450 | 4.79 | 40.50 |
| 3 | 10 | 350 | 97.2 | 0.76 | 14,800 | 0.65 | 25.63 |
| 4 | 10 | 300 | 81.0 | 0.82 | 14,400 | 0.81 | 30.28 |
| 5[5] | 10 | 300 | 89.7 | 0.82 | 14,400 | 0.33 | 40.70 |
| 6[6] | 10 | 300 | 52.6 | 0.86 | 14,800 | 3.64 | N/D |
| 7 | 10 | 300 | 93.4 | 0.74 | 14,000 | 1.39 | 34.69 |
| 8 | 10 | 275 | 73.4 | 0.80 | 14,200 | 0.75 | 39.69 |
| 9 | 20 | 375 | 93.9 | 0.62 | 14,900 | 1.19 | 25.56 |
| 10 | 20 | 325 | 86.9 | 0.76 | 14,300 | 0.79 | N/D |
| 11 | 20 | 300 | 79.6 | 0.85 | 14,500 | 0.78 | N/D |
| 12 | 20 | 275 | 61.6 | 0.84 | 13.900 | 1.76 | 43.21 |

1. Reaction conditions are 10 grams feed coal, 30 grams KOH, 20 grams NaOH and water added as indicated. Time at temperature is 2 hours unless otherwise noted.

2. All sulfur reductions are based on %=(lbs $SO_2$/MM BUT ROM - lbs $SO_2$/MM BTU product)/lbs $SO_2$/MM BTU ROM * 100.

3. Estimated from Dulong equation.

4. Values for PETC MCL Product are averaged.

5. Reaction was one hour at temperature.

6. Reaction was 0.5 hours at temperature.

TABLE 5

Elemental and Sulfur Analyses of Feed and Products

| Entry[1] | C | H | O | N | Sulfate Sulfur[2] | Pyritic Sulfur | Organic Sulfur |
|---|---|---|---|---|---|---|---|
| ROM | 48.37 | 3.64 | 5.50 | 0.74 | 0.03 | 3.06 | 1.75 |
| Feed | 72.54 | 5.00 | 7.25 | 1.01 | 0.01 | 1.42 | 2.30 |
| MCL | 79.76 | 2.95 | 9.84 | 1.43 | 0.02 | 0.15 | 0.51 |
| 1 | 86.13 | 3.91 | 7.37 | 1.23 | 0.22 | 0.01 | 0.28 |
| 2 | 78.21 | 5.36 | 11.19 | 1.46 | 0.40 | 0.03 | 0.35 |
| 3 | 86.31 | 4.47 | 7.02 | 1.24 | 0.02 | 0.00 | 0.16 |
| 4 | 79.32 | 5.31 | 12.42 | 1.46 | 0.71 | 0.00 | 0.38 |
| 5 | 80.98 | 5.54 | 10.63 | 1.51 | 0.20 | 0.01 | 0.39 |
| 6 | 77.05 | 5.51 | 11.78 | 1.48 | 0.27 | 0.04 | 2.31 |
| 7 | 81.08 | 5.02 | 11.56 | 1.40 | 0.02 | 0.00 | 0.36 |
| 8 | 80.03 | 5.50 | 11.45 | 1.46 | 0.02 | 0.01 | 1.47 |
| 9 | 86.87 | 4.47 | 6.35 | 1.28 | 0.23 | 0.01 | 0.15 |
| 10 | 81.75 | 5.20 | 10.58 | 1.43 | 0.30 | 0.01 | 0.36 |

TABLE 5-continued

| Entry[1] | C | H | O | N | Sulfate Sulfur[2] | Pyritic Sulfur | Organic Sulfur |
|---|---|---|---|---|---|---|---|
| | Elemental and Sulfur Analyses of Feed and Products | | | | | | |
| 11 | 80.45 | 5.71 | 11.04 | 1.45 | 0.21 | 0.01 | 0.96 |
| 12 | 78.07 | 5.47 | 11.73 | 1.40 | 0.13 | 0.02 | 1.99 |

1. Entry numbers correspond to Table 4.

2. All C,H,O,N, and S values are on a MF basis. C,H,O,N values are from microelemental analyses, S forms obtained by ASTM D 2492.

Table 6 explains the significance of Tables 4 and 5, by showing the percent of pyritic sulfur and organic sulfur removed for each of runs 1–12 and correlates the percent removal of each with the temperature of the run. The percent pyritic sulfur removed was calculated by subtracting the amount of pyritic sulfur remaining in each Run from 1.42 which is the amount of pyritic sulfur in the feed, see Table 5, second line, and dividing that number by 1.42 then multiplying the result by 100. Run 1 as an example, the amount of pyritic sulfur remaining in the coal after treatment is 0.01, then the calculation is 1.42 minus 0.01 divided by 1.42×100 or 99.30% pyritic sulfur removed. Similarly, the percent organic sulfur removed is calculated by subtracting the amount of organic sulfur left after the completion of the Run from 2.30 which was the amount of organic sulfur in the feed coal divided by 2.3 then multiplying the quotient by 100. Calculating the amount of organic sulfur removed for Run 1 as an example, the calculation is 2.3 minus 0.28 divided by 2.3×100 for a percent organic sulfur removal of 87.83%. Table 6 hereinafter set forth is a list of each run, the percent removal of pyritic sulfur for each run, the percent removal of organic sulfur for each run and the temperature at which the run was conducted obtained from Table 4. Runs 5 and 6 were anomalous in that the reaction time was not two hours as for the other Runs. In Run 5, the reaction time was one hour and in Run 6 the reaction time was one-half hour.

Referring to Table 6, it will be seen that the lowest pyritic sulfur removed in any Run was 97.89% in Runs 2 and the highest was 100% which occurred in Runs 3, 4 and 7. It would be fair to state that over 99% pyritic sulfur removal is routinely obtained with the process of the present invention.

Regarding the percent organic sulfur removal, the results of Run 6 should be discarded. The reaction time was one-half hour and there was within measuring error, no organic sulfur removed. This is clearly outside the invention. In addition, Run 8 which reported a 36.09% organic sulfur removal was conducted at 275° C. The invention requires that the reaction temperature is not less than about 300° C. and accordingly, Run 8 should be discarded from the results as should Run 12 reporting a 17.39% sulfur removal also at 275° C. The only anomalous Run in the preferred temperature range from about 300° C. to about 375° C. is Run 11 reporting 58.26% organic sulfur removal and it is should be discarded as clearly being at odds with the obtained results for all other runs.

Calculating an average organic sulfur removal for Runs 1–5, 7, 9 and 10 which are all of the Runs at 300° C. or greater except the anomalous Run 11, the average sulfur removal is 86.85%. Calculating the organic sulfur removal, only those runs in which the temperature is in the range of from about 300° C. to about 325° C., these being runs 2, 4–7 and 10, discarding the anomalous Run 11, is 84%.

TABLE 6

| Feed | Pyritic Sulfur 1.42 % Sulfur Removal $\frac{1.42 - \text{left}}{1.42} \times 100$ | Organic Sulfur 2.30 $\frac{2.3 - \text{left}}{2.3} \times 100$ | Temp. °C. |
|---|---|---|---|
| 1 | $\frac{1.42 - 0.01}{1.42} \times 100 = 99.3\%$ | $\frac{2.3 - 0.28}{2.3} \times 100 = 87.83\%$ | 375 |
| 2 | $\frac{1.42 - 0.03}{1.42} \times 100 = 97.89\%$ | $\frac{2.3 - 0.35}{0.} \times 100 = 84.78\%$ | 300 |
| 3 | $\frac{1.42 - 0.00}{1.42} \times 100 = 100\%$ | $\frac{2.3 - 0.16}{2.3} \times 100 = 93.04\%$ | 350 |
| 4 | $\frac{1.42 - 0.00}{1.42} \times 100 = 100\%$ | $\frac{2.3 - 0.38}{2.3} \times 100 = 83.48\%$ | 300 |
| 5 | $\frac{1.42 - 0.01}{1.42} \times 100 = 99.30\%$ | $\frac{2.3 - 0.39}{2.3} \times 100 = 83.04\%$ | 300 |
| 6 | $\frac{1.42 - 0.04}{1.42} \times 100 = 97.18\%$ | $\frac{2.3 - 2.31}{2.3} \times 100 = 0\%$ | 300 |
| 7 | $\frac{1.42 - 0.00}{1.42} \times 100 = 100\%$ | $\frac{2.3 - 0.36}{2.3} \times 100 = 84.35\%$ | 300 |
| 8 | $\frac{1.42 - 0.01}{1.42} \times 100 = 99.30\%$ | $\frac{2.3 - 1.47}{2.3} \times 100 = 36.09\%$ | 275 |
| 9 | $\frac{1.42 - 0.01}{1.42} \times 100 = 99.30\%$ | $\frac{2.3 - 0.15}{2.3} \times 100 = 93.48\%$ | 375 |
| 10 | $\frac{1.42 - 0.01}{1.42} \times 100 = 99.30\%$ | $\frac{2.3 - 0.36}{2.3} \times 100 = 84.35\%$ | 325 |
| 11 | $\frac{1.42 - 0.01}{1.42} \times 100 = 99.30\%$ | $\frac{2.3 - 0.96}{2.3} \times 100 = 58.26\%$ | 300 |

TABLE 6-continued

| Feed | Pyritic Sulfur 1.42 % Sulfur Removal $\frac{1.42 - \text{left}}{1.42} \times 100$ | Organic Sulfur 2.30 $\frac{2.3 - \text{left}}{2.3} \times 100$ | Temp. °C. |
|---|---|---|---|
| 12 | $\frac{1.42 - 0.02 \times 100}{1.42} = 98.59\%$ | $\frac{2.3 - 1.99 \times 100}{2.3} = 17.39\%$ | 275 |

While there has been disclosed what is considered to be the preferred embodiment of the present invention, it is understood that various changes in the details may be made without departing from the spirit, or sacrificing any of the advantages of the present invention.

The embodiments of the invention in which an exclusive property or privilege is claimed are defined as follows:

1. A process for reducing the sulfur and ash content of coal, comprising introducing particulate coal into a closed heated reaction chamber having an inert atmosphere, introducing moist caustic wherein the caustic is 50 mole percent NaOH and 50 mole percent KOH and wherein the weight ratio of caustic to coal is about 5 to 1, said moist caustic having a water content in the range of from about 15% by weight to about 35% by weight into the reaction chamber in contact with the coal and maintaining the coal and moist caustic at a temperature not less than about 300° C., transporting the coal and moist caustic to a slurry tank, adding water to the coal and caustic mixture to form an aqueous slurry and thereafter washing said coal with water to remove caustic from the coal and to produce an aqueous caustic solution, evaporating water from the aqueous caustic solution until the caustic has water present in the range of from about 15% by weight to about 35% by weight and reintroducing the moist caustic to the closed reaction chamber, adding sufficient acid to the washed coal slurry to neutralize any remaining caustic present on the coal, washing and thereafter drying the neutralized coal slurry to produce desulfurized coal having not less than about 90% by weight of the sulfur present in the coal feed removed with at least about 80% by weight of the organic sulfur present in the coal feed removed and having an ash content of less than about 2% by weight.

2. The process of claim 1, wherein the particulates are in the range 14×0 to 28×0 mesh.

3. The process of claim 1, wherein the coal particulates are contacted with caustic in said reaction chamber having a pressure not greater than about 98 psig.

4. The process of claim 1, wherein the caustic is in contact with the coal particulate for not less than about 30 minutes.

5. The process of claim 1, wherein the moisture content of the caustic is about 20% by weight and the reaction chamber is maintained at a temperature of about 300° C.

6. The process of claim 5, wherein the ash content of the treated coal particulates is in the range of from about 0.5% to about 1% by weight and about 90% of the sulfur has been removed.

7. The process of claim 5, wherein sulfuric acid is used to neutralize the caustic.

8. The process of claim 1, wherein the coal and the moist caustic is maintained at a temperature in the range of from about 300° C. to about 375° C.

9. The process of claim 1, wherein the time at which the coal and caustic are maintained in contact is not less than about two hours.

10. The process of claim 1, wherein the inert atmosphere is nitrogen.

* * * * *